US005611235A

United States Patent [19]

Bakermans

[11] Patent Number: 5,611,235

[45] Date of Patent: Mar. 18, 1997

[54] POWER DISTRIBUTION MECHANISM IN A STAMPING AND FORMING MACHINE AND METHOD

[75] Inventor: Johannes C. W. Bakermans, Harrisburg, Pa.

[73] Assignee: The Whitaker Corporation, Wilmington, Del.

[21] Appl. No.: 379,053

[22] Filed: Jan. 27, 1995

Related U.S. Application Data

[63] Continuation-in-part of Ser. No. 186,344, Jan. 25, 1994, abandoned.

[51] Int. Cl.[6] ..... B21D 43/05

[52] U.S. Cl. ..... 72/405.06; 72/452.5

[58] Field of Search ..... 72/404, 407, 452, 72/470, 405.06, 421, 452.5; 83/236, 255

[56] References Cited

U.S. PATENT DOCUMENTS

| | | | |
|---|---|---|---|
| 2,275,681 | 3/1942 | Pierson | 72/452 |
| 2,458,538 | 1/1949 | Socke | 83/255 |
| 3,369,387 | 2/1968 | Bradlee | 72/405.06 |
| 3,557,599 | 1/1971 | Eickenhorst | 72/407 |
| 3,695,088 | 10/1972 | Alvi | 72/405 |
| 3,837,210 | 9/1974 | Kralowetz | 72/404 |
| 4,026,226 | 5/1977 | Hahn | 72/405.06 |
| 4,471,644 | 9/1984 | Kimbell | 72/405 |
| 4,497,196 | 2/1985 | Bakermans et al. | 72/405 |
| 4,819,476 | 4/1989 | Bakermans et al. | 72/456 |
| 4,934,173 | 6/1990 | Bakermans | 72/407 |
| 5,007,282 | 4/1991 | Bakermans | 72/481 |
| 5,069,057 | 12/1991 | Lee | 72/452 |

FOREIGN PATENT DOCUMENTS 0546249 6/1993 European Pat. Off. .

*Primary Examiner*—Daniel C. Crane

[57] ABSTRACT

A stamping and forming machine is disclosed having two operating modules with their drive shafts rotationally coupled together. Each module of the machine includes a punch assembly and a mating die assembly that reciprocate horizontally toward and away from each other for performing stamping and forming operations. The rotary motion of the drive shafts effects the reciprocation of the tooling by means of eccentric couplings attached to the drive shafts that drive eccentric links that in turn pivot actuating levers coupled to the tooling. Each module includes an independent feed mechanism that intermittently advances a strip of stock through the module in timed relation to the reciprocating motion of the tooling. The eccentric coupling of the first and second modules are angularly positioned about 120 degrees apart so that during operation, one of the modules has at least partially completed its stamping and forming operation prior to the other module beginning its respective stamping and forming operation, thereby reducing peak loading on the motors driving the drive shafts.

11 Claims, 6 Drawing Sheets

POWER DISTRIBUTION MECHANISM IN A STAMPING AND FORMING MACHINE AND METHOD

This application is a continuation-in-part of application Ser. No. 08/186,344 filed Jan. 25, 1994, now abandoned.

The Present invention relates to stamping and forming machines having two or more operational modules and more particularly to a mechanism for coupling the drive shaft to the reciprocating rams of each module.

BACKGROUND OF THE INVENTION

U.S. Pat. Nos. 4,497,196 and 4,819,476 disclose a stamping and forming machine having first and second ram assemblies which are reciprocable toward and away from each other along horizontal paths of reciprocation. Strip material is fed along a strip feed path which extends between the ram assemblies. The ram assemblies have tooling on their ends for performing stamping and forming operations on the strip. An example of such tooling is disclosed in U.S. Pat. No. 5,007,282 which sets forth a typical punch and die assembly for use in a stamping and forming machine. The ram assemblies are reciprocated by oscillating levers to which they are coupled. The levers, in turn, are coupled to a drive shaft by eccentric assemblies and the drive shafts of the two modules are rotationally coupled together. The eccentric assemblies of the two modules are typically aligned in the same angular position on their respective drive shafts so that as the coupled drive shafts are rotated the tooling in both modules are in similar position with respect to the strip of stock. That is, when the tooling of one module is fully withdrawn so is the tooling of the other module and when the tooling of one module is performing a stamping and forming operation on the strip of stock so is the tooling of other module. When the power required to perform these two stamping and forming operation simultaneously exceeds the power available from the drive motor, the operations must be altered to reduce the power requirements, usually by decreasing the number of stamping and forming progressions. This, of course, reduces the efficiency of the operation. By phase shifting the two stamping and forming operations, the available power can be more evenly distributed. This is usually accomplished, as disclosed in U.S. Pat. No. 3,557,599, which issued Jan. 26, 1971 to Eickenhorst, by arranging adjacent tooling stations so that there is an angular displacement of the drive shaft between the time that the tooling of one station performs its operation and the time that the tooling of the adjacent station engages the strip of stock to perform its operation. However, since the strip of stock being operated upon cannot be advanced until all of the stamping and forming operations in all of the stations are complete and the tooling withdrawn from the strip, there is substantially less angular movement of the drive shaft available for operating the feed mechanism. The present invention addresses this situation by phase shifting the power requirements of the two modules so that they do not require peak power at the same time during rotation of the coupled drive shafts while providing independent feed mechanisms in each of the two modules.

SUMMARY OF THE INVENTION

A stamping and forming machine is disclosed of the type having at least two stamping and forming modules for performing stamping and forming operations on strip stock. Each module includes a drive shaft, first and second ram assemblies which are reciprocable toward and away from each other between forward and retracted positions, and first and second actuator levers for reciprocating the ram assemblies. Each lever is coupled to its associated ram assembly, has a fixed pivot relative to the frame of the module, and is coupled to the drive shaft for effecting the reciprocation of the ram assembly. A feed mechanism is coupled to and driven by the drive shaft of its respective module for intermittently advancing the strip of stock within the module in timed relationship with the reciprocating movement of the two ram assemblies, and independent of advancement of the strip of stock within the other modules. The modules have their drive shafts rotationally coupled together to form a common drive shaft. The first and second levers of the first module are coupled to their respective drive shaft by first and second couplings at a first angular position while the first and second levers of the second module are coupled to their respective drive shaft at a second angular position different from the first angular position. The first and second couplings are arranged so that during operation, one of the modules has at least partially completed its stamping and forming operation prior to the other of the modules beginning its respective stamping and forming operation.

DESCRIPTION OF THE PREFERRED EMBODIMENT

Figure 1:
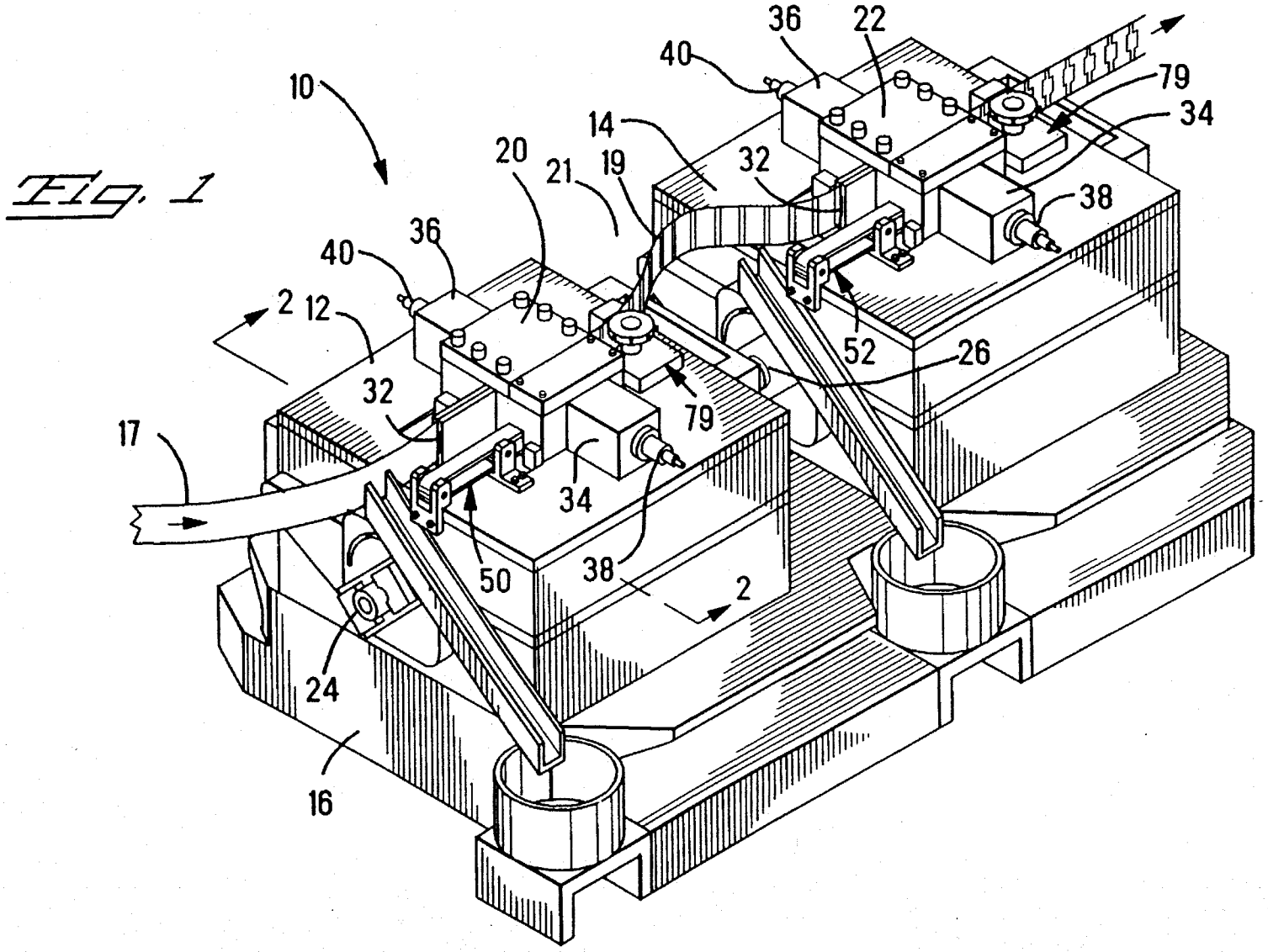
FIG. 1 is an isometric view of a two module stamping and forming machine incorporating the teachings of the present invention.
Figure 2:
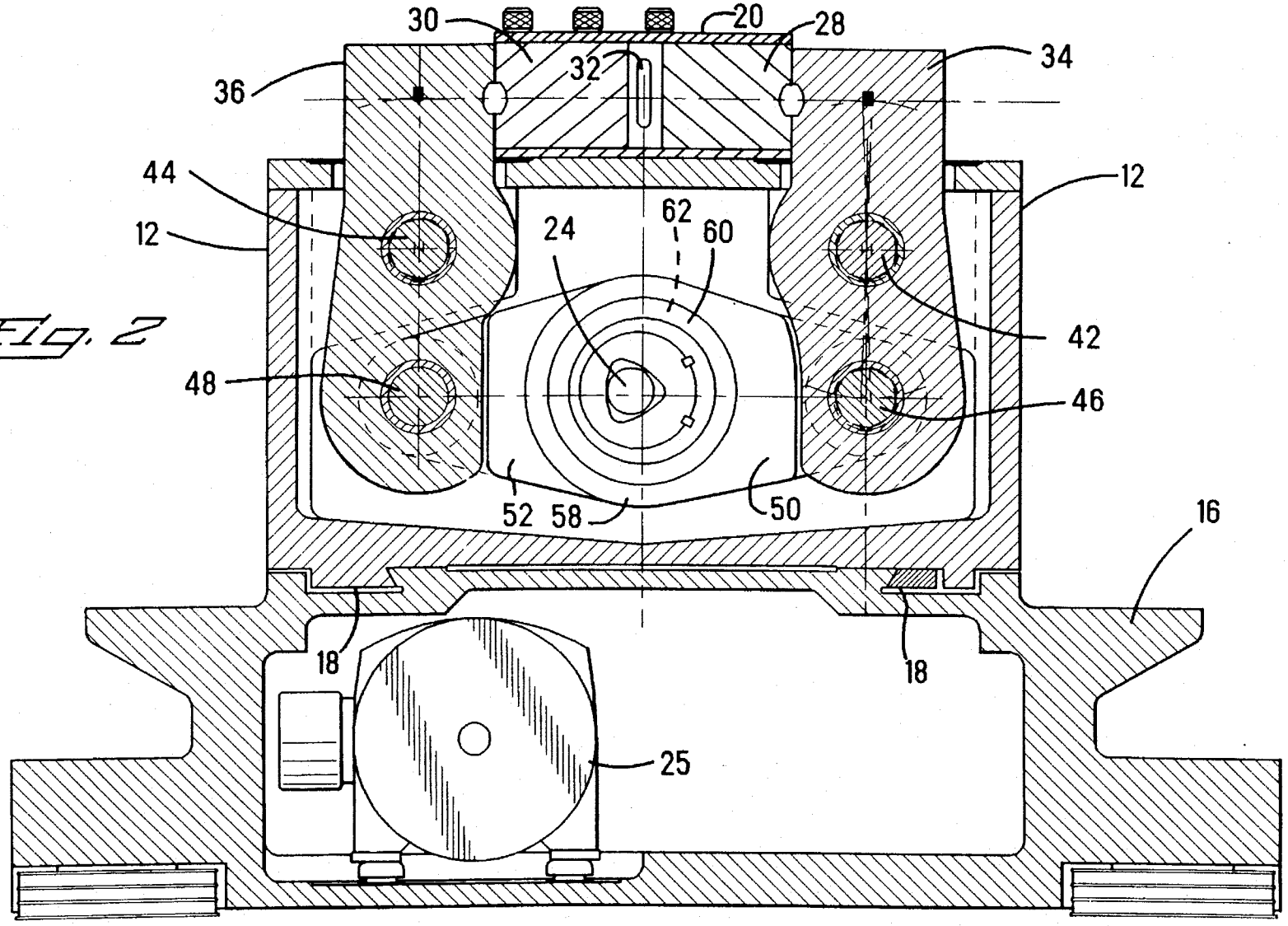
FIG. 2 is a partial cross-sectional view taken vertically through one of the modules shown in FIG. 1.

There is shown in FIGS. 1 and 2 a stamping and forming machine 10 having a first stamping and forming module 12 and a second stamping and forming module 14. FIG. 2 is a cross section of the entire machine 10 taken through the first module 12 approximately along the lines 2—2 in FIG. 1. The first and second modules, 12 and 14, are mounted to a machine base 16 and arranged in ways 18, as best seen in FIG. 2, so that their relative spacing can be adjusted when the machine is set up for a particular job. This means of adjustment is provided, in prior art universal stamping and forming machines, to assure that the tooling in the first module will be in proper alignment with respect to the tooling in the second module so that a strip having operations performed on it in the first module will be in proper alignment in the second module for further operations there. This is required because the strip 17 being operated on, in the prior art machines, extends between adjacent modules with little or no appreciable slack. However, the present invention requires a substantial slack or bowed area 19 in the strip 17 in the space 21 between adjacent modules, as shown in FIG. 1, for a purpose that will be explained below. The modules 12 and 14 have first and second tooling assemblies 20 and 22, respectively, mounted to their top mounting plates, as shown in FIG. 1. Each module has a drive shaft 24 and an electric motor 25 for rotating the drive shaft during operation of the machine. The motor is coupled to the drive shaft 24 by means of a belt and pulley in the usual manner. The two drive shafts 24 are rotationally coupled together by a coupling assembly 26. It should be noted that some models of the machine 10 have a single motor for driving the coupled drive shafts 24 of the two modules. Each tooling assembly 20 and 22 includes a pair of opposing ram assemblies 28 and 30 which contain tooling on their ends which mate to perform the stamping and forming operation on strip stock that is fed through aligned slots 32. The opposing ram assemblies of each module are arranged to reciprocate toward and away from each other along horizontal paths. The rams 28 and 30 are caused to reciprocate by means of first and second levers 34 and 36 which are coupled to their respective rams as shown at 38 and 40. Each lever 34, 36 is pivoted intermediate its ends at 42 and 44 and its lower end is pivoted at 46, 48 to the drive shaft 24 by means of a pair of eccentrically coupled links 50 and 52, respectively.

Figures 3, 4:
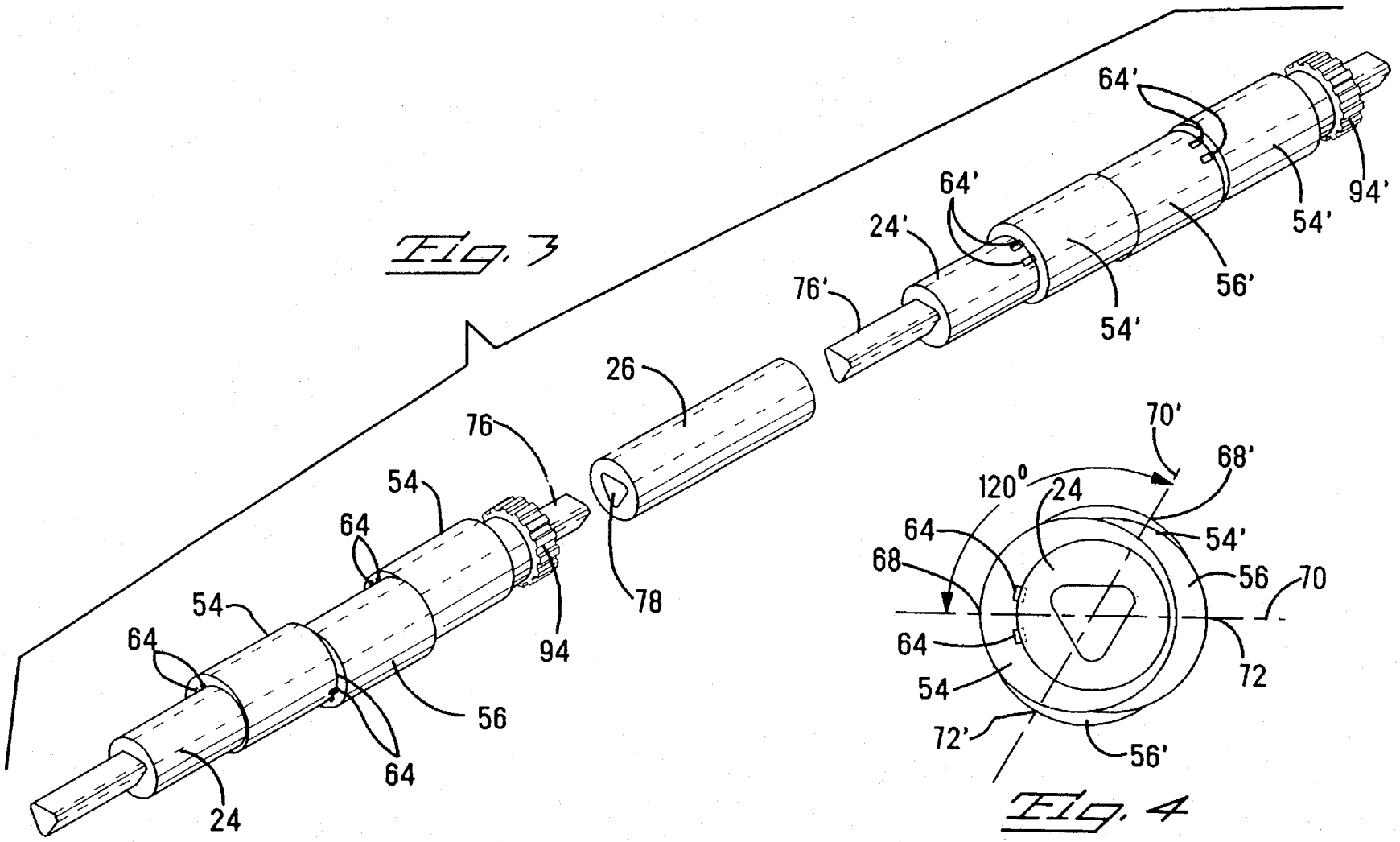
FIG. 3 is an isometric view of the drive shafts of the two modules showing the relative positions of the eccentrics.
FIG. 4 is an end view of the two drive shafts shown in FIG. 3.

The eccentric coupling links 50 and 52 of each module are coupled to the drive shaft 24 by means of two eccentrics 54 and an eccentric 56, as best seen in FIGS. 3 and 4. The link 50 has a bifurcated end 58 having a through bore containing a roller bearing 60 in each side of the link, while the link 52 has a single end having a bore containing a roller bearing 62. The inner races of the roller bearings 60 and 62 receive the outer diameters of their respective eccentrics 54 and 56. Note that in FIGS. 3 and 4 the identifying numbers associated with the drive shaft, attached eccentrics, and related features are identical for both modules except that in the case of the second module the numbers are primed. Each of the eccentrics 54 is keyed to the drive shaft 24 in mutual axial alignment by means of two keys 64 arranged in keyways formed in both the shaft and the eccentric in the usual manner. The high point 68 of each of the eccentrics 54 coincides with a first position line 70 that extends through the center of the drive shaft, as best seen in FIG. 4. The eccentric 56 is arranged between the two eccentrics 54 and is keyed to the drive shaft 24 in a similar manner but with its high point 72 coincident with the position line 70 on the opposite side of the shaft from the high point 68. In the second module the drive shaft 24' and eccentrics 54' and 56' are arranged identically to that of the first module. However, when the two modules 12 and 14 are assembled to the machine base 16 and the drive shafts 24 and 24' are about to be coupled together by means of the coupling assembly 26, the drive shaft 24' is first rotated, clockwise in the present example as shown in FIG. 4, until its position line 70' is 120 degrees out of phase from the position line 70 of the drive shaft 24. The two drive shafts 24 and 24' are then coupled together by the coupling assembly 26. In the present example each of the two opposing ends 76 and 76' of the shafts 24 and 24' are formed in the shape of a three sided polygon, both of which are a slip fit with an opening 78 in the coupling assembly 26. Since the end 76' can be received within the opening 78 in either of three angular positions that are 120 degrees apart, to achieve the 120 degrees out of phase condition between the two drive shafts 24 and 24', it is only necessary to select the appropriate angular position. With this system the two drive shafts 24 and 24' can easily be returned to an in phase condition if the peak power requirements of the two modules are within acceptable limits and it is desired that the shafts be in phase for some particular purpose. While a three sided polygon shaft end is shown in the present example, any number of sides may be advantageously utilized. In such cases, the drive shaft 24' will be rotated to a suitable angular position with respect to the shaft 24 that is closest to achieving the desired 120 degree, or any desired angle out of phase condition between the two position lines 70 and 70'.

Figure 11:
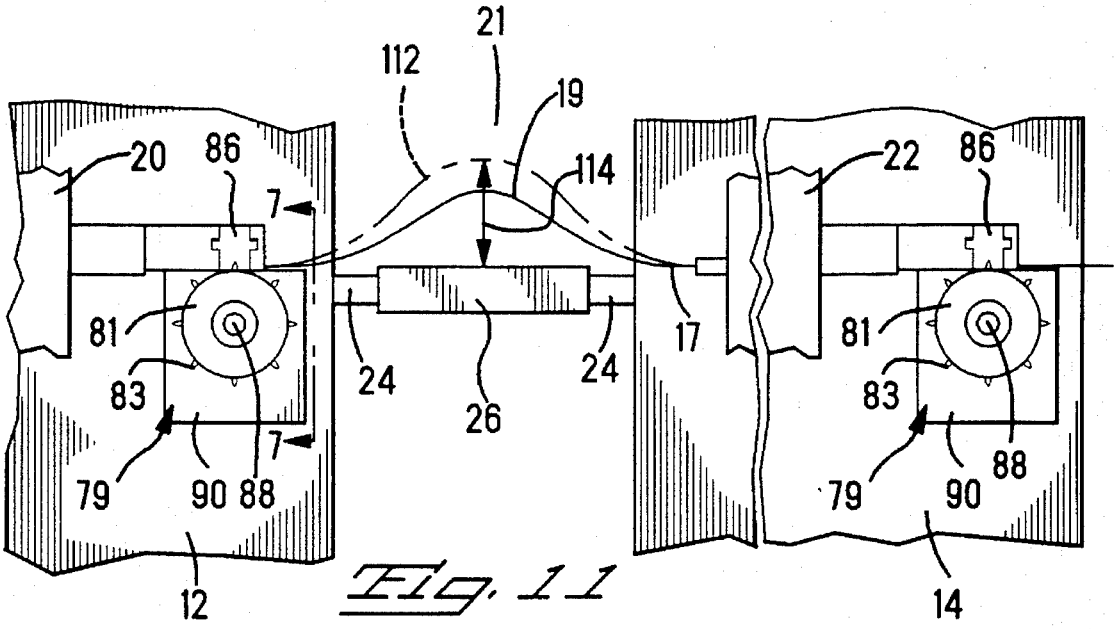
FIG. 11 is a top view of a portion of the machine shown in FIG. 1.
Figure 12:
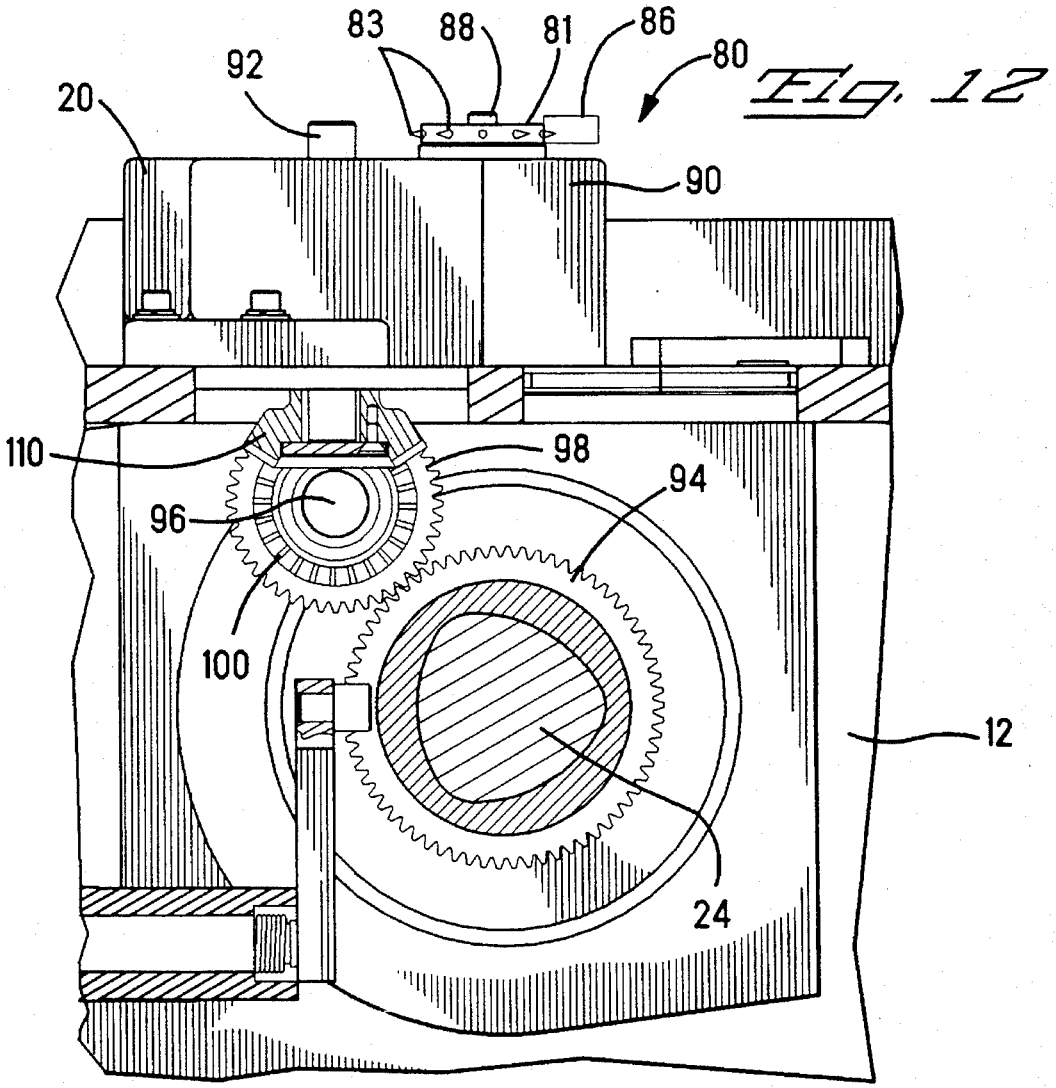
FIG. 12 is a partial cross-sectional view taken along the lines 7—7 in FIG. 6.

Each of the first and second modules 12 and 14 includes a strip feed mechanism 79, as shown in FIG. 1. Each feed mechanism is independently driven by the shaft 24, 24' of its respective module. As shown in FIGS. 11 and 12, each feed mechanism 79 includes a feed wheel 81 having feed teeth 83 projecting from its periphery for engaging openings in the strip 17, and a mating backup member 86 which holds the strip in feeding engagement with the feed wheel. The feed wheel 81 is coupled to an output shaft 88 of an intermittent motion mechanism 90. The mechanism 90 has an input shaft 92 that is driven by the drive shaft 24, 24' of its respective module 12, 14 by means of a spur gear 94 and 94' attached to the drive shaft 24, 24', as shown in FIG. 3. As best seen in FIG. 12, an intermediate shaft 96 is journaled for rotation in the frame of each module 12 and 14 and includes a spur gear 98 that is in driven engagement with the gear 94, 94'. A bevel gear 100 is attached to the shaft 96 and is in driving engagement with a mating bevel gear 110 that is attached to the input shaft 92. As each drive shaft 24, 24' rotates, during operation of the machine 10, the corresponding intermittent motion mechanism 90 of each feed mechanism 79 is driven so that its respective feed wheel 81 is intermittently rotated in timed relation to the reciprocating movement of the ram assemblies of the module. The timing is arranged so that the feed wheel of each module will advance the strip 17 within its respective module during the portion of the machine cycle between the time when the tooling has completely disengaged the strip after performing a stamping and forming operation to the time when the tooling is approaching the strip for performing a subsequent stamping and forming operation. The feed mechanism 79 is more fully described in U.S. Pat. No. 4,887,452 which issued Dec. 19, 1989 to Bakermans and which is incorporated herein by reference. Note that each of the first and second modules 12 and 14 will be performing their respective operations out of phase, as will be explained below. That is, as the first module begins its operation, the drive shafts 24 and 24' must rotate an additional amount, 120 degrees in the present example, before the second module begins its operation. It will be understood that, independent of the phase relationship of the first and second modules, each feed mechanism 79 will operate in timed relation to its respective module only. Therefore, when the feed mechanism of one module is advancing the strip 17, the feed mechanism of the other module is not necessarily advancing the strip 17. As this occurs, the area 19 of the strip 17 within the space 21 between the two modules will follow an arcuate path that varies in size and position, as best seen in FIG. 11. As the first module 12 begins to feed and the strip is advanced in the first module, the area 19 of the strip will bow out to the position shown in phantom lines at 112 in FIG. 11. When strip advancement in the first module is complete and as the strip is advanced in the second module the area 19 of the strip will move back to the position shown in solid lines in FIG. 11. The amount of bowing and the actual positions of the bowed area 19 within the space 21 will depend on the phase angle used between the two drive shafts 24 and 24' and the length of the feed stroke. For example, where the space 21 is about 30 inches long and the feed stroke is 2.5 inches, the bowed area 19 of the strip must bow outwardly about 6 inches at its maximum, indicated as the distance 114, to assure that there is some amount of bow left when the bow is minimized, as shown in solid lines in FIG. 11. Otherwise the feed mechanism of the second module will attempt to advance the strip without an adequate supply and will damage the strip or the feed mechanism.

Figure 5:
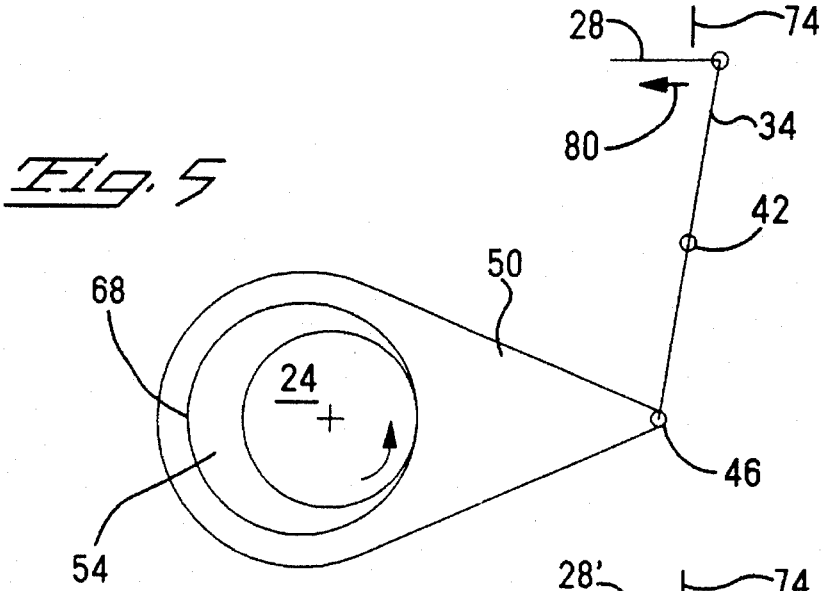
FIGS. 5 through 10 are schematic representations of the eccentric couplings showing their relative positions at various rotational positions of the drive shafts.
Figure 6:
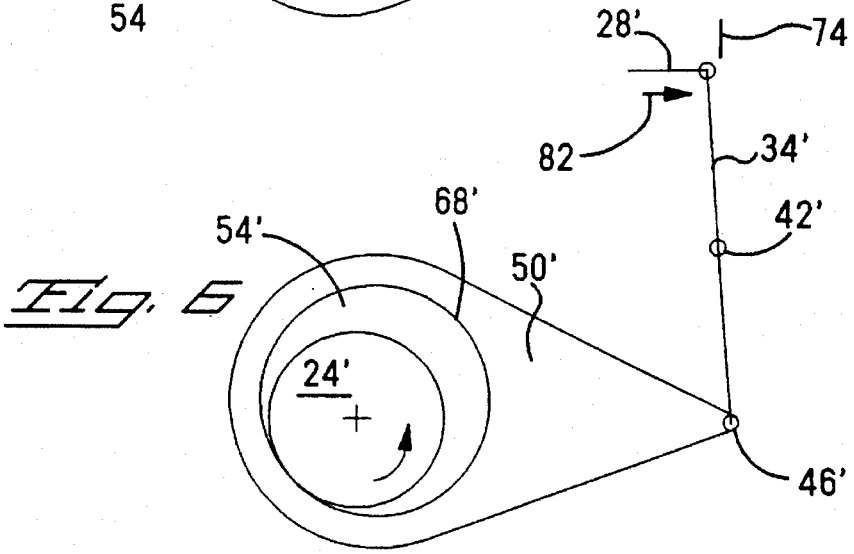
Figure 7:
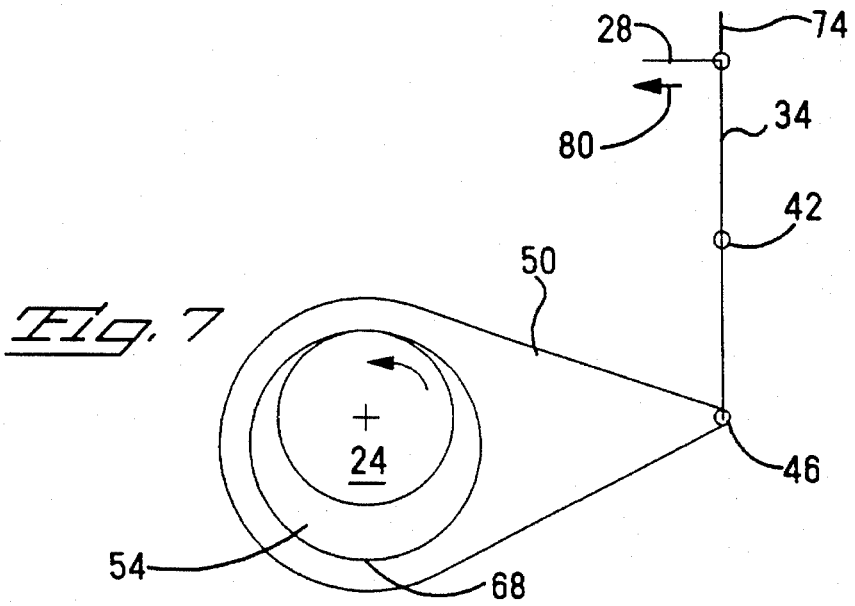
Figure 8:
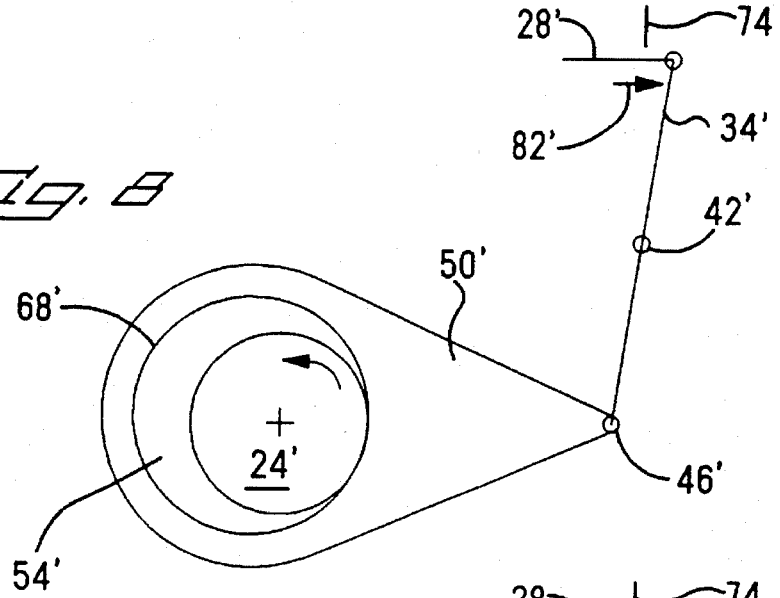
Figure 9:
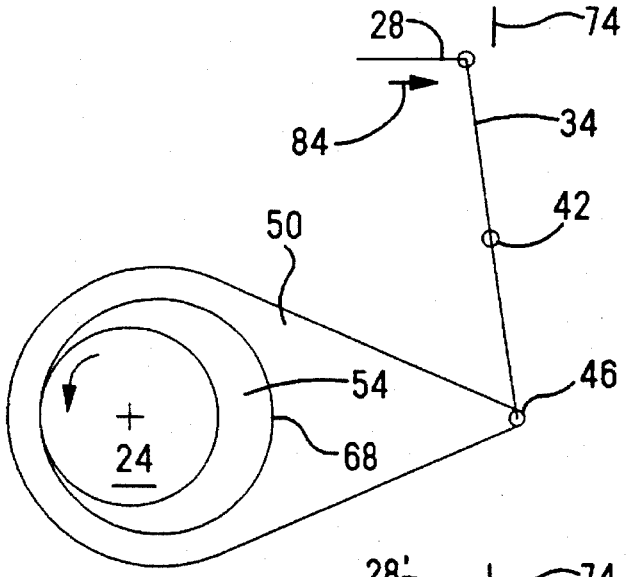
Figure 10:
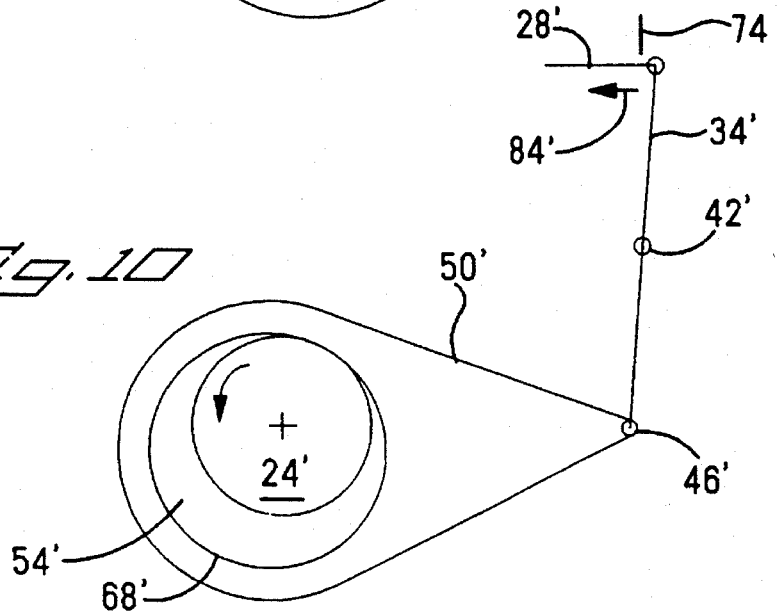

The operation of the eccentric coupling links with respect to the out of phase condition of the two drive shafts 24 and 24' will now be described, with reference to FIGS. 5 through 10. There is schematically shown in FIGS. 5, 7, and 9 an end view of the drive shaft 24 with the high point 68 of the eccentric 54 in the 9 o'clock, 6 o'clock, and 3 o'clock positions respectively, and the corresponding positions of the eccentric link 50, the lever 34, and the ram assembly 28. Similarly, FIGS. 6, 8, and 10 show the drive shaft 24' with the high point 68' of the eccentric 54' in angular positions that are 120 degrees clockwise from the positions of the high points 68 in FIGS. 5, 7, and 9, respectively. Note that for purposes of FIGS. 5 through 10 the two drive shafts 24 and 24' are considered to be coupled together as shown in FIG. 4. As the shaft 24 rotates counterclockwise from the position shown in FIG. 5 where the ram assembly 28 is fully withdrawn to the right of the center mark 74, the eccentric rotates to the position shown in FIG. 7 where the ram assembly 28 is in its center position in alignment with the center mark 74, and finally the eccentric rotates to the position shown in FIG. 9 where the ram assembly 28 is in its fully engaged position to the left of the center mark 74. All of the stamping and forming operations performed by the first module 12 are accomplished during rotation of the shaft 24 between the positions shown in FIGS. 7 and 9, most being performed in the last few degrees of rotation as the drive shaft approaches the position shown in FIG. 9. Therefore, the peak loading of the tooling of the first module occurs very close to the position of the shaft 24 shown in FIG. 9. In contrast, with reference to FIGS. 5 and 6, the high point 68' of the eccentric 54' is 120 degrees retarded from the high point 68 of the eccentric 54. Note that the ram assembly 28 is moving leftward toward the mating ram assembly 30 as indicated by the arrow 80 while the ram assembly 28' is moving in the opposite direction as indicated by the arrow 82. As the shafts 24 and 24' reach the positions shown in FIGS. 7 and 8 the ram assembly 28 is still moving leftward and the ram assembly 28' is still moving rightward past the center mark 74. As rotation of the shafts 24 and 24' continue, the shaft 24 reaches the position shown in FIG. 9 where all of the stamping and forming work is complete in the first module for this machine cycle and the ram assembly 28 begins to reverse direction as indicated by the arrow 84. As the tooling of the second module 14 disengages the strip 17 its feed mechanism 79 advances the strip within the second module. Simultaneously, the lever 34', as shown in FIG. 10, is approaching the center mark 74 with the ram assembly 28' moving toward its mating ram assembly 30' so that their respective tooling assemblies can begin to engage the strip of stock and perform the stamping and forming operation in the second module. Note that when in the position shown in FIG. 10, the ram assembly 28' has not advanced far enough to begin the stamping and forming operation, therefore, the peak force required by the first module 12 has occurred well prior to the occurrence of the peak force required by the second module 14. As rotation continues, the ram assembly 28' advances toward the mating ram assembly 30' until their respective tooling assemblies engage and perform their stamping and forming operation, while the ram assembly 28 continues to retract in the direction of the arrow 84. As the tooling of the first module 14 disengages the strip 17 its feed mechanism 79 advances the strip within the second module. Rotation of the drive shafts 24 and 24' continues until they reach the position shown in FIGS. 5 and 6. At this point the machine cycle is repeated until the desired operation is complete.

It will be understood that, while an out of phase angle of 120 degrees is utilized in the present example, other suitable angular displacements will be advantageous, depending upon the configuration of the specific tooling assemblies 20 and 22. Additionally, the machine 10 may have three or more modules requiring that the peak loadings of each of the modules be angularly displaced. In such cases an angular displacement of less than 120 degrees may be necessary. Angular displacements of between about 30 degrees and about 150 degrees will be suitable for most configurations of tooling assemblies, however a specific angle will be preferred for each such configuration. The most important requirement of the out of phase condition between the various drive shafts in the machine is that the peak loading requirements of the tooling assemblies in the various modules be distributed about the 360 degrees of a single rotation of the drive shaft so that there is no overlap resulting in a peak force that exceeds the capacity of the drive motor 25. Additionally, the strip feed mechanisms of each module operate independently and they are each timed in relation to the operation of their respective module. This requires that the strip of stock be arranged so that the portion of the strip that is between adjacent modules is sufficiently bowed to provide an adequate supply to the downstream module when its feed mechanism advances the strip.

An important advantage of the present invention is that the machine 10 may utilize tooling assemblies having higher individual peak power requirement than would otherwise be possible while providing a normal amount of angular movement of the drive shaft for operating the strip feed mechanism. This results in higher efficiency through an increase in the number of stamping and forming progressions within the tooling than would otherwise be possible for a particular product.

What is claimed is:

1. In a machine having first and second spaced apart stamping and forming modules for concurrently performing stamping and forming operations on a single continuous strip of stock which passes through first and second mutually aligned slots in said first and second stamping and forming modules, respectively, and between said two modules along an arcuate path during feeding thereof, each said module including:

a drive shaft;

two opposing ram assemblies which undergo reciprocating movement toward and away from each other including tooling attached thereto for engaging said strip of stock and performing said operations thereon;

first and second actuator levers, each coupled to a respective one of said two ram assemblies, and being coupled to said drive shaft by first and second couplings for effecting said reciprocating movement of each said respective ram assembly;

a feed mechanism coupled to and driven by said drive shaft of its respective module for intermittently advancing said strip of stock within said respective module in timed relationship with said reciprocating movement of said two ram assemblies, and independent of advancement of said strip of stock within the other of said first and second modules, wherein said first and second modules have their respective drive shafts selectively rotationally coupled together at a desired relative angle so that said first and second couplings of said first module are at a first angular position and said first and second couplings of said second module are at a second angular position different from said first angular position, so that during operation, said first module has at least partially completed its said stamping and forming operation prior to said second module beginning its respective stamping and forming operation.

2. The machine according to claim 1 wherein said feed mechanism and said first and second couplings of each of said first and second modules are arranged so that upon completion of said operation in said first module said feed mechanism thereof begins advancing said strip of stock within said first module before said feed mechanism of said second module begins advancing said strip of stock within said second module thereby varying said arcuate path of said strip of stock.

3. The machine according to claim 2 wherein each of said first and second couplings comprises an eccentric attached to said drive shaft and an eccentrically coupled link having a bore, the outer diameter of said eccentric being journaled for rotation in said bore, and said eccentrically coupled link pivotally attached to one of said first and second levers.

4. The machine according to claim 3 wherein said first and second couplings are arranged diametrically opposed on said drive shaft.

5. The machine according to claim 3 wherein said eccentrics of said first and second couplings are attached to said drive shaft by means of a key in keyways formed in both said drive shaft and said eccentrics.

6. The machine according to claim 1 wherein said second angular position is displaced from said first angular position by an angle of about 30 degrees to about 150 degrees.

7. The machine according to claim 1 wherein said second angular position is displaced from said first angular position by an angle of about 120 degrees.

8. In a method of performing manufacturing operations on a strip of stock by means of a stamping and forming machine, said machine having first and second spaced apart stamping and forming modules for concurrently performing stamping and forming operations on a single continuous strip of stock which passes through first and second mutually aligned slots in said first and second stamping and forming modules, respectively, and between said two modules along an arcuate path during feeding thereof, each said module including a feed mechanism arranged to advance said strip of stock in a direction of feed within its respective module independent of advancement of said strip within the other of said first and second modules, the steps comprising:

(1) performing a first manufacturing operation on said strip in said first module;

(2) then advancing said strip through said first aligned slot in said direction of feed within said first module and into said space between said first and second modules;

(3) after said operation in step (1) is at least partially completed, performing a second manufacturing operation on said strip in said second module; and (4) independent of said advancing said strip in step (2), advancing said strip through said second aligned slot in said direction of feed within said second module.

9. The method according to claim 8 wherein said advancing said strip in step (2) begins prior to beginning said advancing said strip in step (4).

10. The method according to claim 8 wherein step (1) through step (4) are performed during rotation of said drive shaft through 360 degrees, and immediately after said operation in step (1) begins said shaft rotates 120 degrees and then said operation in step (3) immediately begins.

11. The method according to claim 8 wherein said advancing said strip in steps (2) and (4) are mutually out of phase so that said portion of said strip between said first and second modules follows a varying arcuate path.

* * * * *